US007866200B1

(12) United States Patent
Winer et al.

(10) Patent No.: US 7,866,200 B1
(45) Date of Patent: Jan. 11, 2011

(54) BED PIN CHANNEL

(75) Inventors: Gregory J. Winer, Kentwood, MI (US); Douglas Michael Johnson, Dorr, MI (US); Robert Edward Leedy, Hastings, MI (US)

(73) Assignee: R.T. London Company, Grand Rapids, MI (US)

( * ) Notice: Subject to any disclaimer, the term of this patent is extended or adjusted under 35 U.S.C. 154(b) by 568 days.

(21) Appl. No.: 11/865,137

(22) Filed: Oct. 1, 2007

Related U.S. Application Data

(60) Provisional application No. 60/827,540, filed on Sep. 29, 2006.

(51) Int. Cl.
*B21D 31/00* (2006.01)

(52) U.S. Cl. ..... 72/379.2; 72/324

(58) Field of Classification Search ..... 72/324, 72/325, 326, 379.2, 335, 340, 389.1; 248/62, 248/74.1

See application file for complete search history.

(56) References Cited

U.S. PATENT DOCUMENTS 1,005,980 A * 10/1911 Katzinger ..... 72/358
1,707,668 A * 4/1929 Manson ..... 72/379.2
1,959,744 A * 5/1934 Stein ..... 72/377
2,746,131 A * 5/1956 Elliott ..... 29/879
2,996,570 A * 8/1961 Wilson ..... 174/163 F
3,421,355 A * 1/1969 Kramer ..... 72/338
4,361,024 A * 11/1982 Haldric ..... 72/324
4,646,552 A * 3/1987 Kanbe ..... 72/339
4,719,788 A * 1/1988 Musil ..... 72/379.2
4,850,646 A 7/1989 Wieland
4,893,958 A 1/1990 Wieland
4,941,340 A * 7/1990 Nowak et al. ..... 72/379.2
5,069,506 A 12/1991 Wieland
5,188,474 A * 2/1993 Ohkubo et al. ..... 403/57
5,419,043 A * 5/1995 Laue ..... 29/897.2
5,738,414 A 4/1998 Wieland et al.
6,267,446 B1 7/2001 Wieland et al.
6,508,440 B2 * 1/2003 Schmidt ..... 248/62
6,595,592 B1 7/2003 Wieland et al.
6,609,285 B1 * 8/2003 Kinney ..... 29/407.05
6,688,699 B1 2/2004 Bowie

FOREIGN PATENT DOCUMENTS

JP 57-195544 * 12/1982
JP 59-121229 * 7/1984

* cited by examiner

*Primary Examiner*—Edward Tolan
(74) *Attorney, Agent, or Firm*—McGarry Bair PC

(57) ABSTRACT

A pin channel is formed from a unitary piece of sheet material into a U-shape with integral support posts adapted to support a hanger. The support posts are formed from bosses shaped in the sheet material with no assembly of parts or pieces.

5 Claims, 5 Drawing Sheets

BED PIN CHANNEL

CROSS REFERENCE TO RELATED APPLICATIONS

This application claims the benefit of U.S. Provisional Patent Application Ser. No. 60/827,540, filed Sep. 29, 2006.

BACKGROUND OF THE INVENTION

1. Field of the Invention

The invention relates to pin channels and more particularly to the structure and fabrication of pin channels such as those used in bed frames.

2. Description of the Related Art

Case goods sold to institutions such as schools and colleges often include beds comprising wooden headboards, footboards, and metal bed frames. The bed frames are commonly fabricated from angle iron side rails and end rails, welded together in a square with one or more reinforcing pieces extending between the side rails. Springs or wires are strung between the rails to support a mattress. The frames typically have hooks that are sized to rest on pins in the headboards and footboards. Multiple pins can be located in either a bed post or the headboard to allow the frame to be positioned in any of a number of different heights. The pins are normally located in a U-shaped channel mounted on or in the headboard or bed post. It is known in the art to use pin channels in a bed in order to allow the aforementioned height adjustments.

A known method for making a pin channel is shown in FIG. 1. A metal sheet has two outer sections 1 and an inner section 2 as defined by the dotted lines. Holes 5 are punched into both outer sections 1 in corresponding pairs. A cylindrical peg 3 is pressed into one of each pair of corresponding holes 5 leaving a free end of the peg. The sheet is then folded into a "U-shape" along the dotted lines where the free end of each cylindrical peg 3 is pressed into the other of the pair of corresponding holes 5. Alternatively, the sheet is folded first so that holes 5 of the corresponding pairs are in registry, and each cylindrical peg 3 is pressed through both holes. In this manner, a metal cylindrical peg 3 is secured in each pair of previously punched holes 5 and forms a support where a fastening tab may be hung. The assembly of the bed pin channel in this manner is a labor-intensive, time consuming, and expensive process. Pin channels for other applications are equally costly to make.

SUMMARY OF THE INVENTION

A pin channel according to the invention includes a pair of substantially parallel elongated outer sections connected to each other by a web section, and at least one boss extending from each outer section. Each boss has a distal edge abutting the adjacent distal edge to form a support post. In this manner, the pin channel is formed form a unitary piece of sheet material.

Preferably, the sheet material is metal. As well, the pin channel can have mounting apertures in the web section. Preferably, at least two support posts are formed of pairs of bosses.

In another aspect of the invention, a method of making a pin channel includes the steps of providing a sheet material having two outer sections spaced from each other by a web section, forming at least one boss in each outer section where a portion of the sheet material is drawn generally normally from the surface of the sheet, and folding the outer sections relative the web section until the outer sections are substantially parallel to each other. Thus, the boss in one outer section abuts the boss in the other outer section to form a support post.

Preferably, the forming step includes making an aperture and urging a tool through the aperture to draw the material portion. As well, the method can include the further step of forming mounting apertures in the web section. Preferably, the sheet material is metal. Further the forming step comprises forming more than one boss on each outer section.

DETAILED DESCRIPTION

Figure 1:
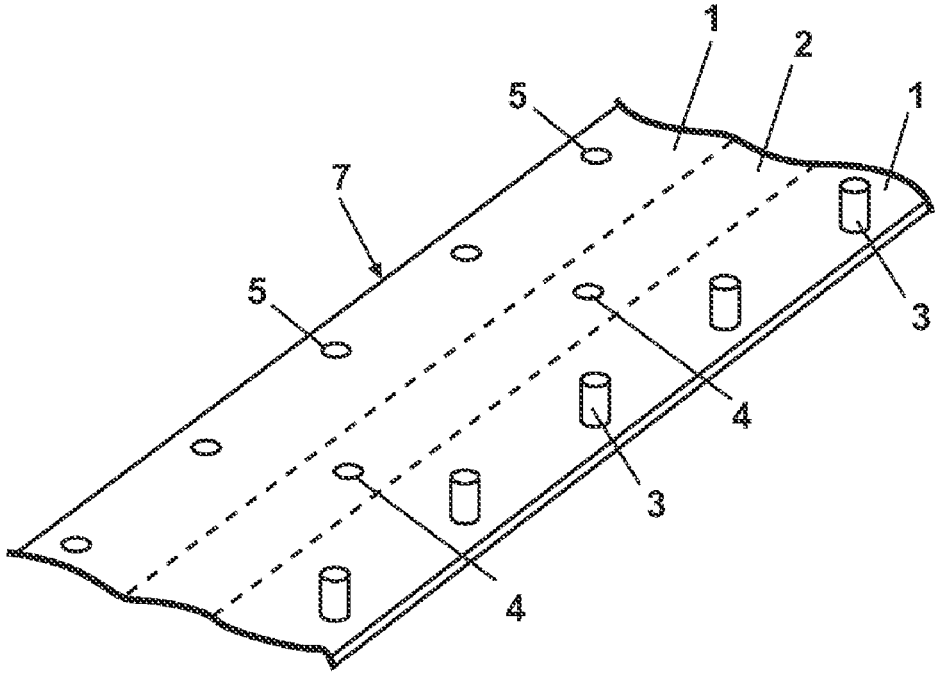
Fig. 1 (PRIOR ART)
FIG. 1 is shows a prior art pin channel with pegs inserted into one side of the metal sheet.
Figure 2:
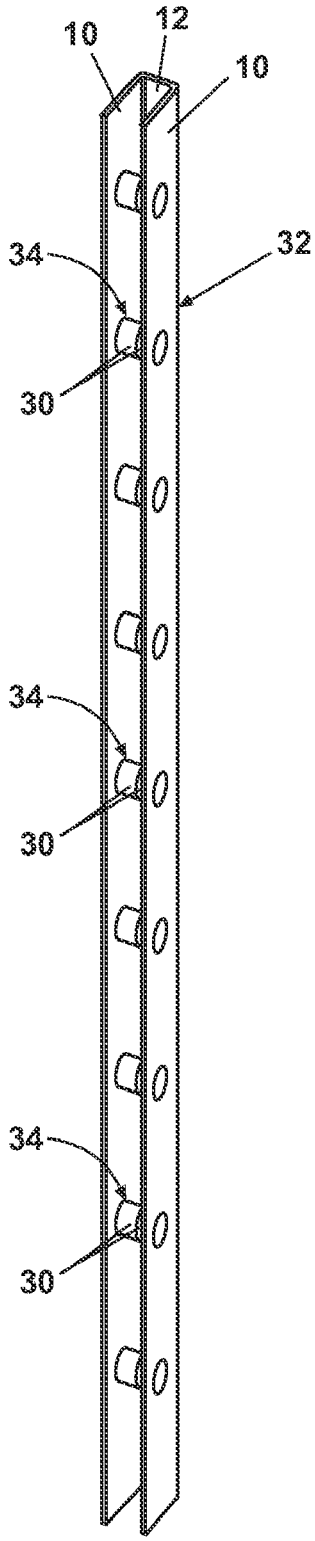
FIG. 2 is a perspective view of a pin channel according to the invention.

FIG. 2 shows a pin channel 32 according to the invention, with a series of support posts 34, formed according to the invention. The pin channel 32 according to the invention can be utilized to provide support for a bed frame while allowing the height to be adjusted, in the same manner as prior art pin channels. The difference is that the cost and time to manufacture the pin channel 32 is much less than provided by the prior art. The pin channel 32 may be used as an attachment to a sole bed frame, or it can be mounted into another frame material such as wood, for any application that requires tabs to hang on the posts 34 in the pin channel. For bed frames, the pin channel 32 can be mounted at any number of locations including in the bed frame or headboard. A recess can be made in the headboard unit or the bed frame posts so the pin channel 32 will be recessed into the headboard or into the bedpost.

The pin channel 32 is a long, "U-shaped" channel which can be formed of steel or any other suitable material. The support posts 34 are formed of pairs of bosses 30 that are integrally shaped in the material of the pin channel 32, each one of the pair abutting the other. The bosses 30 extend from generally parallel, spaced outer sections 10 that are connected to each other by a web section 12. One exemplary method for making the support posts 34 is set forth below. Each support post 34 can serve as a height adjustment location when attaching hanging tabs of a frame member such as sections of a bed frame or headboard.

Figure 3:
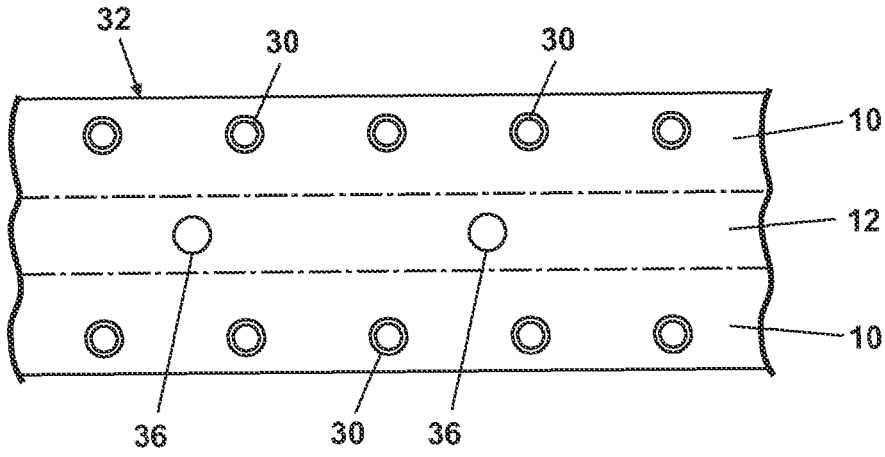
FIG. 3 is a top view of the sheet with holes pre-punched and punched into the channel before folding.
Figure 4:
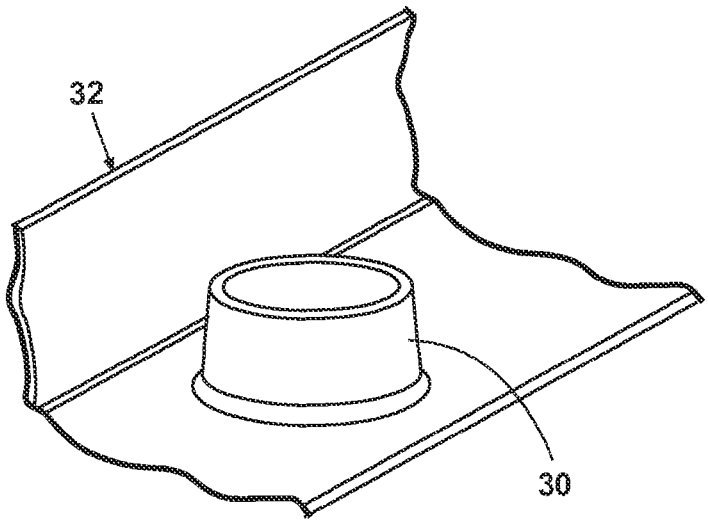
FIG. 4 is a perspective view of one outer section and its pre punched hole along with part of the inner section.
Figure 5:
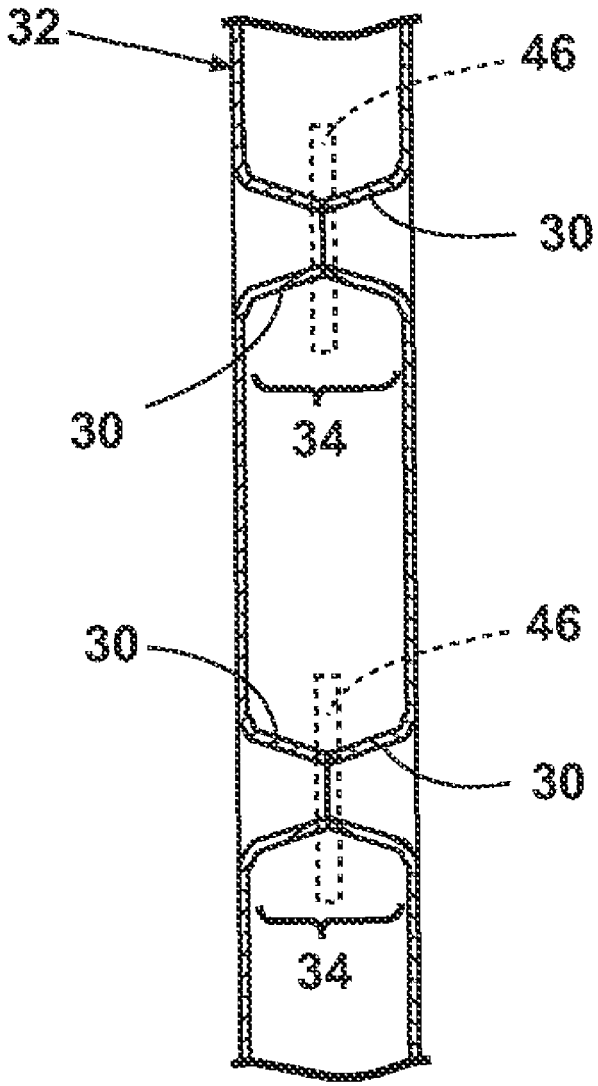
FIG. 5 is a front view of the pin channel with fastening tabs in phantom.

A method for making a pin channel according to the invention is illustrated in FIGS. 3 through 5. Looking first at FIG. 3, a sheet, preferably sheet metal has two outer sections 10 and a web section 12, as defined by phantom dotted lines. Mounting apertures 36 are located in the web section 12 at predetermined locations, and preferably formed by stamping or punching. Boss apertures are also located in the outer sections 10 at predetermined locations, in corresponding pairs. They are likewise preferably formed by stamping or punching. A tool is then urged through each boss aperture to draw and extend the sheet material normal to the surface of the sheet to form a truncated conical boss 30, having a proximal base and a distal edge surrounding the boss aperture. The sheet is then folded into a U-shape along the phantom dotted lines, as shown in FIG. 4, where the distal edges of the pairs of corresponding bosses 30 meet to form a support post 34. The time and costs for such fabrication are greatly reduced inasmuch as the punching operation, the drawing operation, and the folding operation can be accomplished automatically and quickly, either sequentially, or in one or more simultaneous combinations. The formation of the pin channel 32 in this manner does not require assembly of multiple parts and pieces.

Figure 6:
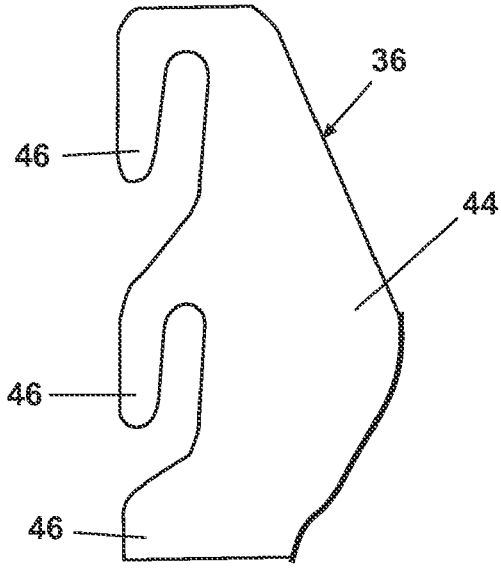
FIG. 6 is a flat side view of an example of a fastening tab.
Figure 7:
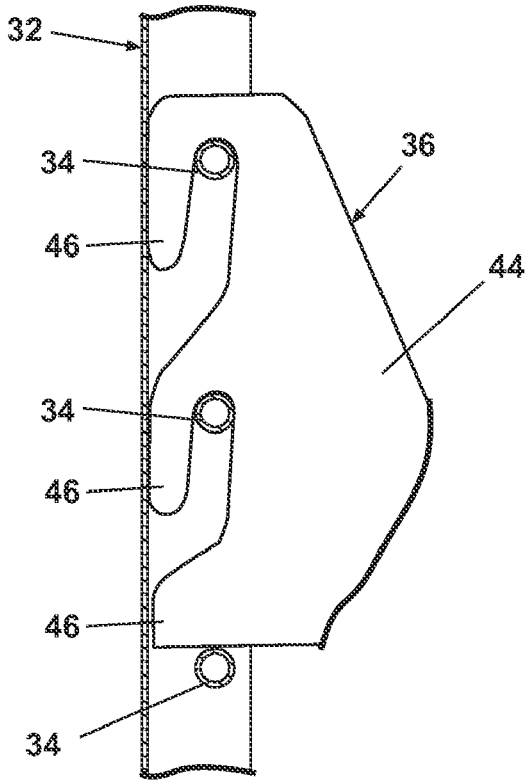
FIG. 7 is a sectional view of the inside of the channel and a fastening tab resting on the supports.

FIG. 5 shows the support posts 34 formed from the pairs of bosses 30. A fastening tab 46 can be seen in phantom resting on two support posts 34. FIGS. 6 and 7 show a frame 36 with fastening tabs 46 as they are hooked onto the support posts 34 in the pin channel 32. The mounting apertures 36 can be used to mount the pin channel to a support apparatus such as a bed frame.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of making an elongated pin channel that supports a bed frame comprising the steps of:

providing a sheet material having two elongated planar outer sections spaced from each other by an elongated planar web section;

forming at least one truncated conical boss in each outer section by drawing a portion of the sheet material normally from the surface of the sheet wherein the at least one truncated conical boss has a distal edge; and folding the two planar outer sections at right angles relative to the planar web section so the planar outer sections are spaced from and parallel to each other, wherein the distal edge of at least one boss in one outer section abuts the distal edge of at least one boss in the other outer section to form a support pin between the spaced outer sections;

whereby when the elongated pin channel is mounted to a bed post by way of the planar web section, a bed frame may be hung on the formed support pin within the parallel outer sections.

2. The method according to claim 1 wherein the forming step comprises making an aperture and urging a tool through the aperture to draw the material portion.

3. The method according to claim 1 comprising the further step of forming mounting apertures in the web section.

4. The method according to claim 1 wherein the sheet material is metal.

5. The method according to claim 1 wherein the forming step comprises forming more than one boss on each outer section.

* * * * *